US007967737B2

(12) United States Patent
Watson

(10) Patent No.: US 7,967,737 B2
(45) Date of Patent: Jun. 28, 2011

(54) WORKOUT BAR

(76) Inventor: Gary Watson, Chicago, IL (US)

( * ) Notice: Subject to any disclaimer, the term of this patent is extended or adjusted under 35 U.S.C. 154(b) by 0 days.

(21) Appl. No.: 12/703,849

(22) Filed: Feb. 11, 2010

(65) Prior Publication Data

US 2010/0204026 A1 Aug. 12, 2010

Related U.S. Application Data

(60) Provisional application No. 61/151,897, filed on Feb. 12, 2009.

(51) Int. Cl.
*A63B 71/00* (2006.01)

(52) U.S. Cl. ..... 482/139

(58) Field of Classification Search ..... 482/121–130, 482/91, 148, 37, 23, 44, 40–41, 139
See application file for complete search history.

(56) References Cited

U.S. PATENT DOCUMENTS

| | | | | |
|---|---|---|---|---|
| 2,508,567 | A * | 5/1950 | Dymeck | 482/106 |
| 5,312,314 | A * | 5/1994 | Stephan et al. | 482/148 |
| 6,663,542 | B1 * | 12/2003 | Trabbic | 482/106 |
| 6,676,575 | B1 * | 1/2004 | Mayo | 482/104 |
| 6,945,918 | B1 * | 9/2005 | Hill | 482/106 |
| 2006/0211552 | A1 * | 9/2006 | Williams | 482/139 |

* cited by examiner

*Primary Examiner* — Lori Baker
(74) *Attorney, Agent, or Firm* — Adam Sacharoff; Much Shelist

(57) ABSTRACT

Preferably, there is defined a "w" shaped exercise bar, a short elongated central shaft that easily comes apart, a pair of hand grip portions disposed on either side of the central shaft, and a pair of removable jump rope handles with adjustable color coded-retractable ropes hidden inside the handles.

15 Claims, 6 Drawing Sheets

WORKOUT BAR

CROSS REFERENCE TO RELATED APPLICATIONS

This application claims priority to U.S. Provisional Application 61/151,897 filed on Feb. 12, 2009.

FIELD OF INVENTION

This invention relates to exercise bars, dumbbells and jump ropes and, more particularly to a hand operable exercise bar for training the musculoskeletal, cardiovascular, and functional range of motion systems for kids in the tween and teen age group (ages 8 and up).

BACKGROUND OF THE INVENTION

People in all walks of life can benefit from increasing the musculoskeletal strength, flexibility, and cardiovascular conditioning systems within their bodies. There are various pieces of exercise equipment that may be used to develop similar results/benefits. Such equipment includes weights, dumbbells, selectorized resistance machines, flex stretch bars, hydraulic resistance machines, commercialized cardiovascular conditioning/aerobic machines (treadmills, step mills, elliptical trainers, etc . . . ), and many varieties of jump ropes. Much of this equipment is very expensive, not easily portable, and just not made safely for kids. Specifically, those pieces of selectorized equipment made for and used by children are very space inefficient, extremely costly, and require constant adult supervision in order to operate safely. Finally, many such previous devices and equipment provide far too much resistance for the growing body of a child.

Accordingly, a need remains for a multi-functional body bar in order to overcome the above-noted shortcomings. The present invention satisfies such a need by providing a multi-functional body bar that is easy and convenient to use, has three different/separate exercise pieces when transformed, is relatively light weight in design, has smaller dimensions to specifically fit the needs of children ages 8 and up, is safely designed at an appropriate resistance level for kids, and is convenient and space efficient allowing and encouraging any child age 8 and up to start and continue a safe, fun exercise program. The versatility of the exercise bar makes it appealing since the user can maximize all the benefits of working out (resistance, stretching and aerobic training), maximizing the benefits received from the time they spent working out.

SUMMARY OF THE INVENTION

Use of the bar of the present invention, which transforms into a pair of dumbbells and an adjustable jump rope, is of particular advantage in many types of strength, toning, cardiovascular, and stretching exercise programs for kids.

Preferably, the invention is concerned with a unique "w" shaped exercise bar, a short elongated central shaft that easily comes apart, a pair of hand grip portions disposed on either side of the central shaft, and a pair of removable jump rope handles with adjustable color coded-retractable ropes hidden inside the handles. When together, the bar is ergonomically designed to fit the smaller frames of the age demographic it is intended for (children ages 8 and up), allowing them to perform many exercises in the field of musculoskeletal strengthening, musculoskeletal flexibility, and cardiovascular conditioning. When the bar is taken apart and transformed, the individual pieces complete a pair of light weight dumbbells and an adjustable jump rope designed to fit any child's size from 3 ft to 7 ft tall.

Numerous advantages and features of the invention will become readily apparent from the following detailed description of the invention and the embodiments thereof, and from the accompanying drawings.

BRIEF DESCRIPTION OF THE DRAWINGS

A fuller understanding of the foregoing may be had by reference to the accompanying drawings, wherein.

DESCRIPTION OF THE DRAWINGS

Figure 1:
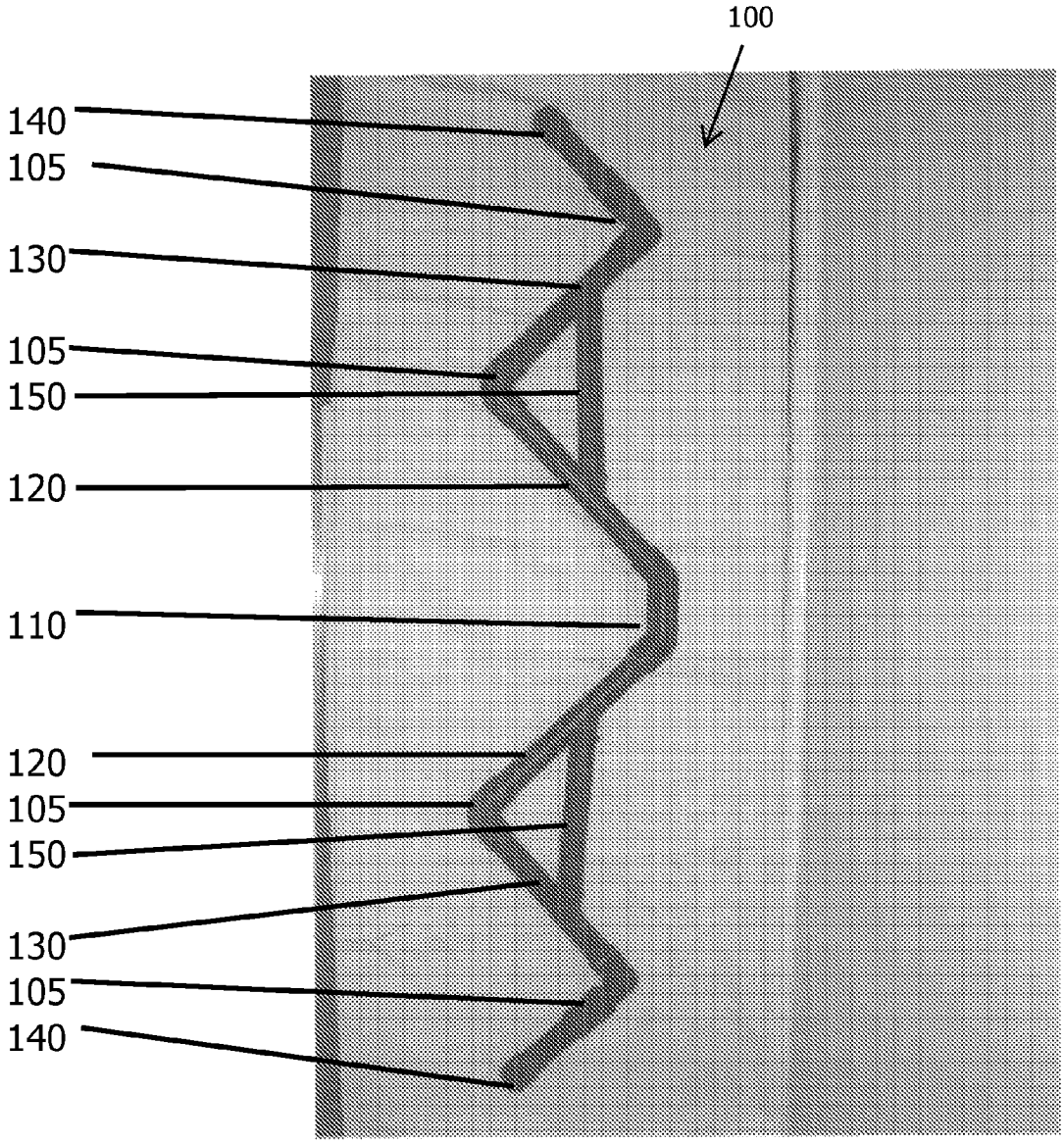
FIG. 1 is a front view of the workout bar in accordance to the first embodiment of the invention.

While the invention is susceptible to embodiments in many different forms, there are shown in the drawings and will described herein, in detail, the preferred embodiments of the present invention. It should be understood, however, that the present disclosure is to be considered an exemplification of the principles of the invention and is not intended to limit the spirit or scope of the invention and/or embodiments illustrated.

FIG. 1 illustrates the assembled exercise bar 100. The bar 100 represent a W shaped exercise bar that includes a middle section 110 that connects outwardly to two sloped first bars 120. The two first bars 120 are each connected at their ends to oppositely sloped second bars 130. The end connections 105 may be similar to an elbow bracket. The second bars 130 further connect at their ends to oppositely sloped third bars 140. Again the end connections 105 may be similar to the elbow brackets connecting the first and second bars. Two cross bars 150 connect middle regions of the first and second sloped bars.

Figure 2B:
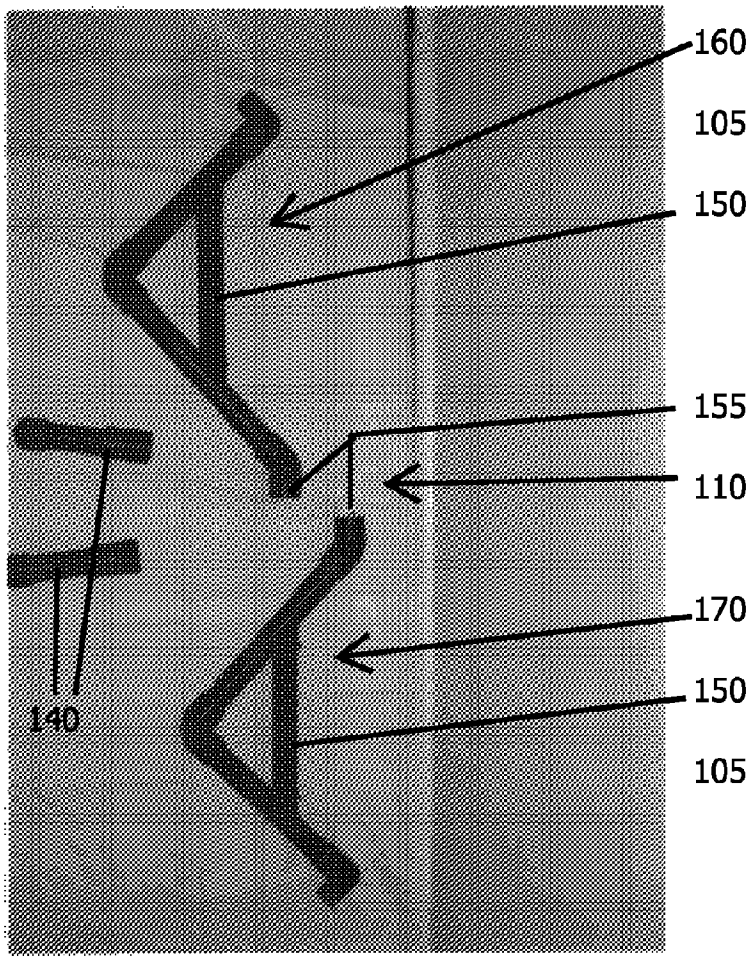
FIG. 2B is an exploded view of FIG. 1.
Figure 2A:
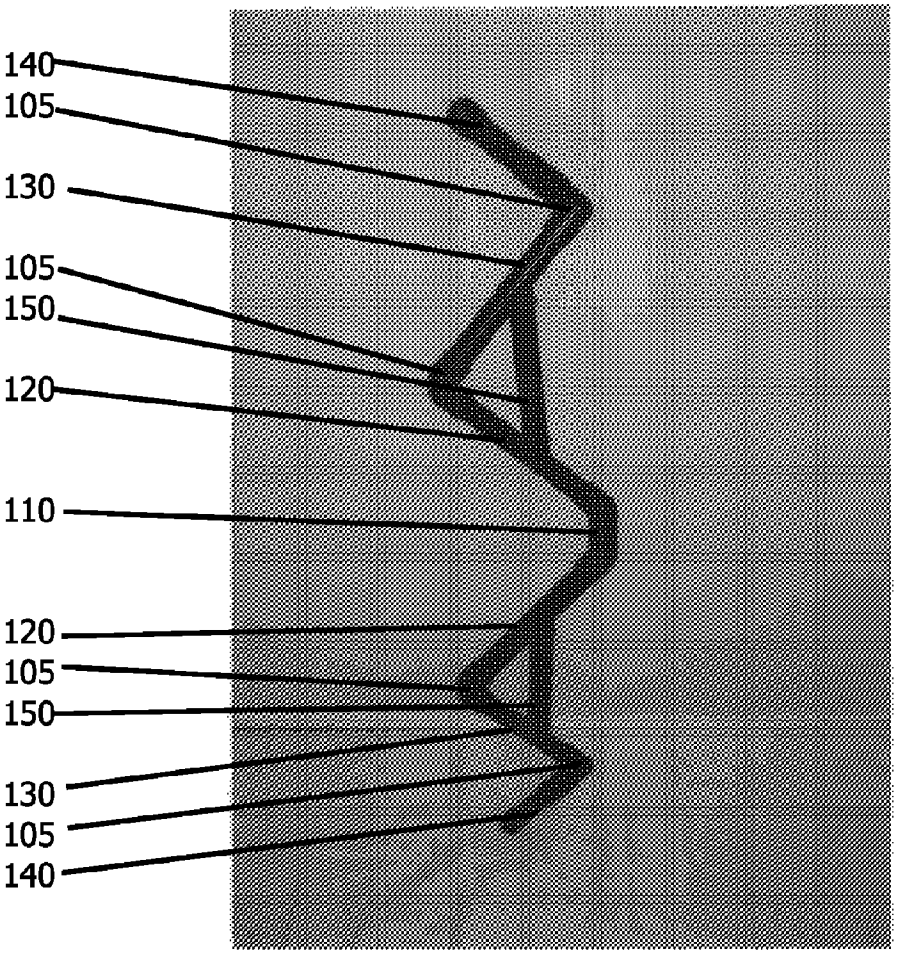
FIG. 2A is a back view of FIG. 1.

FIGS. 2A and 2B illustrate that the exercise bar 100 can be taken apart at a connection point 155 to form two separate dumbbells 160 and 170. Each dumbbell uses the cross bars 150 as handles. In addition the third bars 140 can be removed to help keep the dumbbells balanced.

Figure 3:
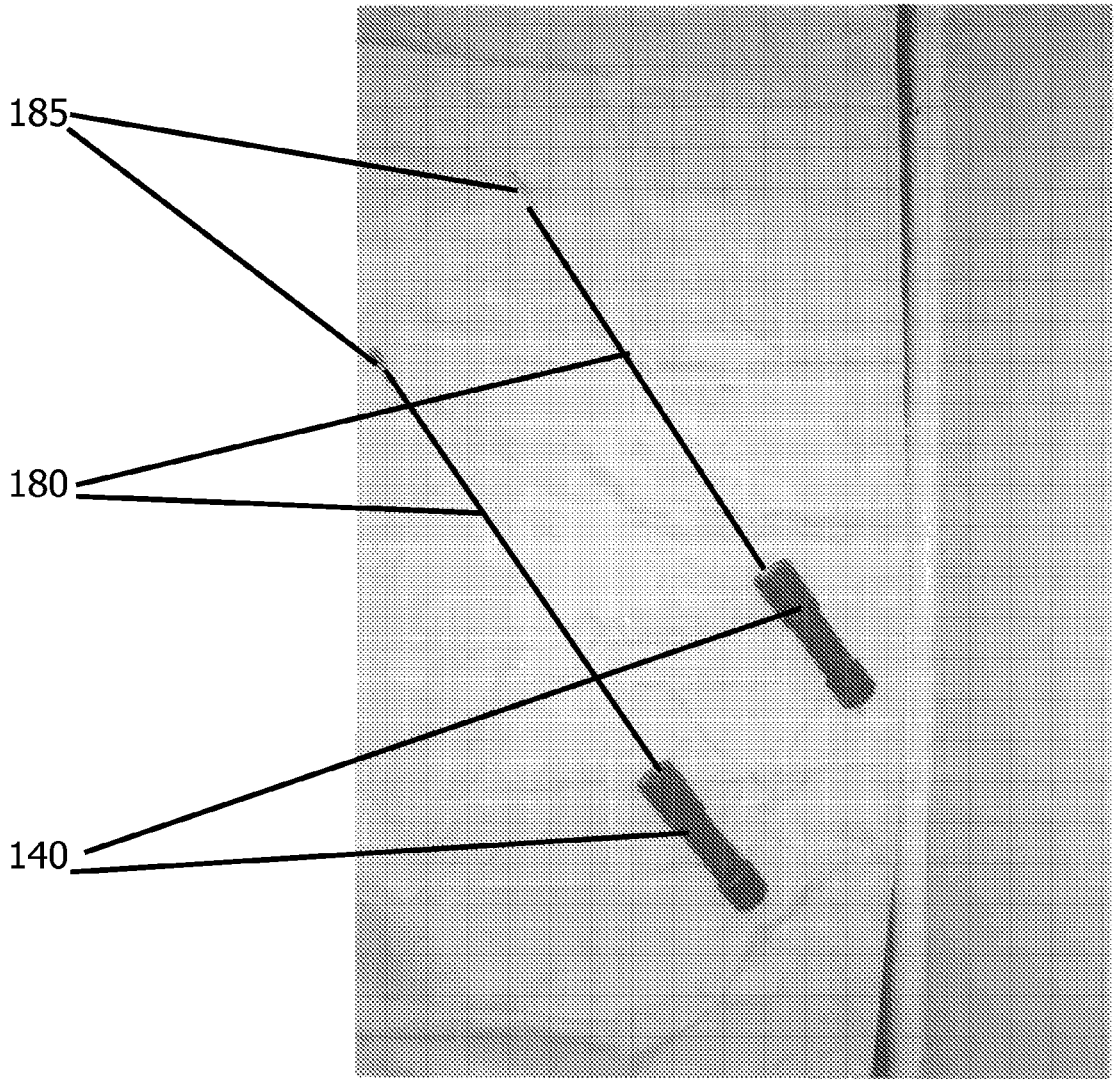
FIG. 3 is a perspective view of the end handles having jump rope extending therefrom.
Figure 4:
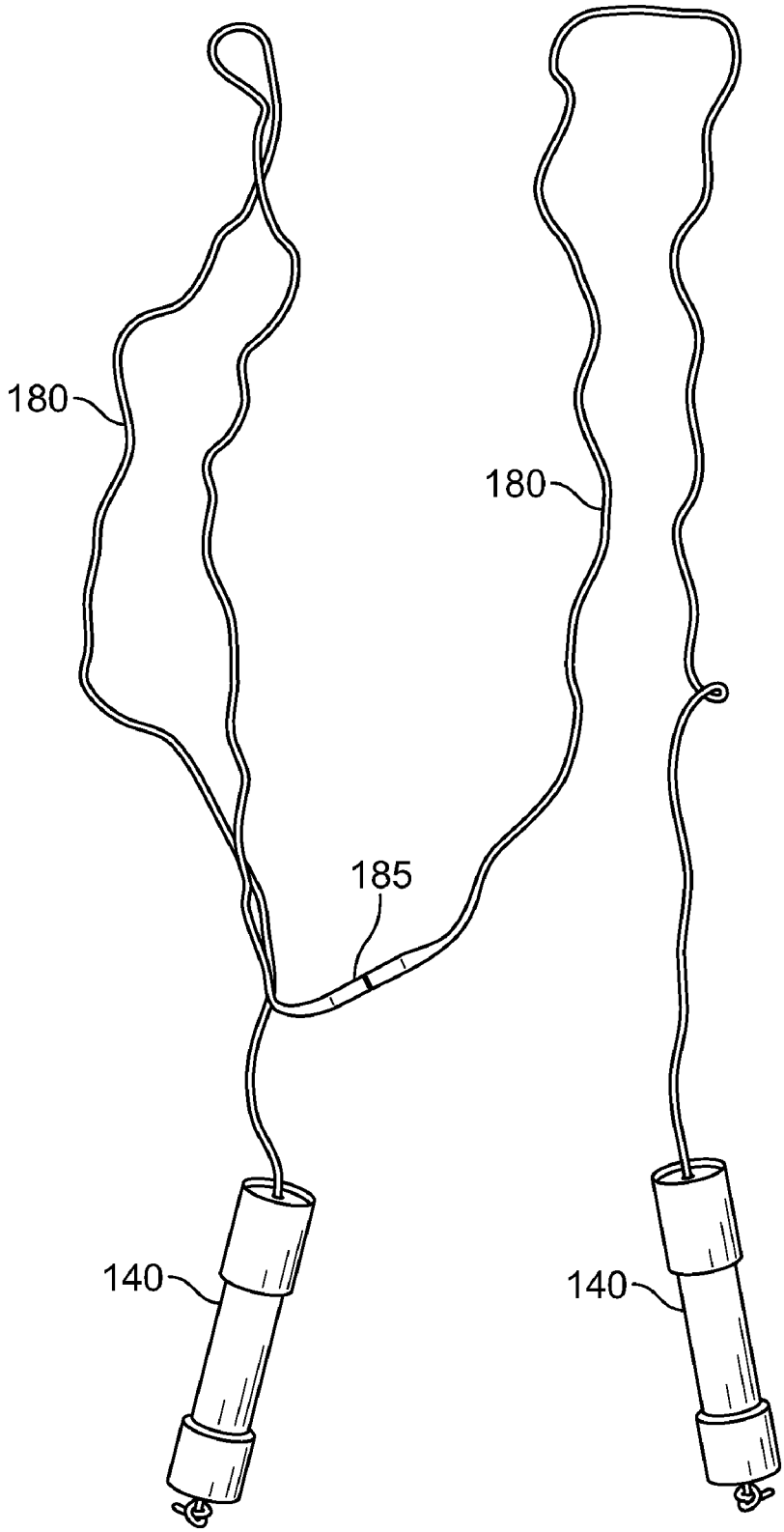
FIG. 4 is a perspective view showing the two end handles having the jump rope connected to each other.
Figure 5C:
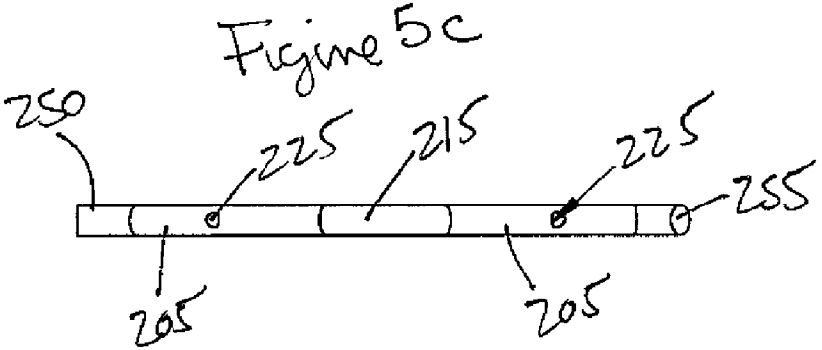
FIGS. 5A through 5C illustrate a dumbbell used to form a workout bar in accordance to a second embodiment of the invention.
Figure 5B:
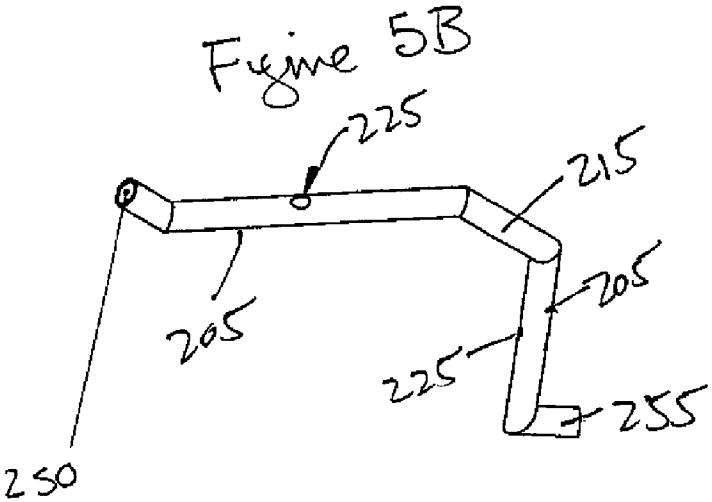
Figure 5A:
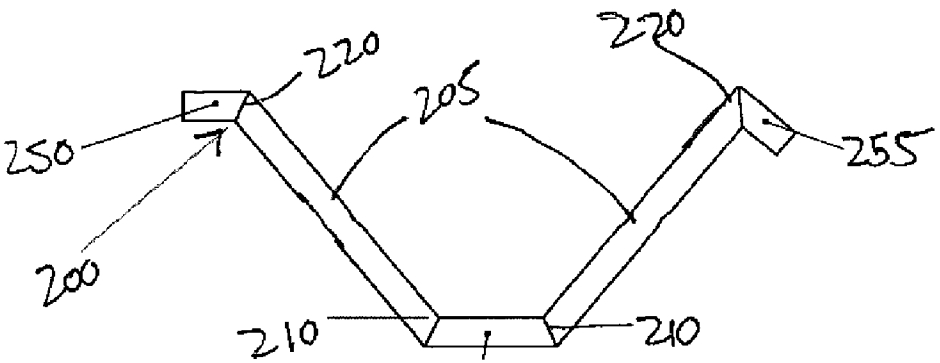
Figure 6D:
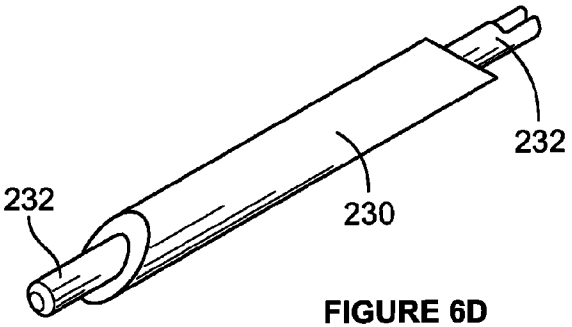
FIGS. 6A through 6F illustrate the removable handles used with the dumbbell to change the weight of the dumbbell and or workout bar.
Figure 6E:
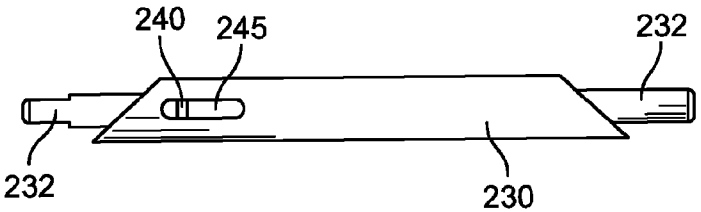
Figure 6F:
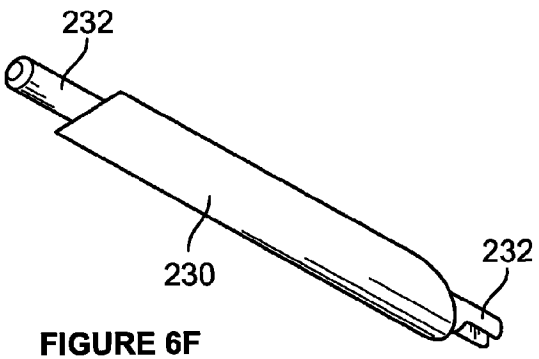
Figure 6A:
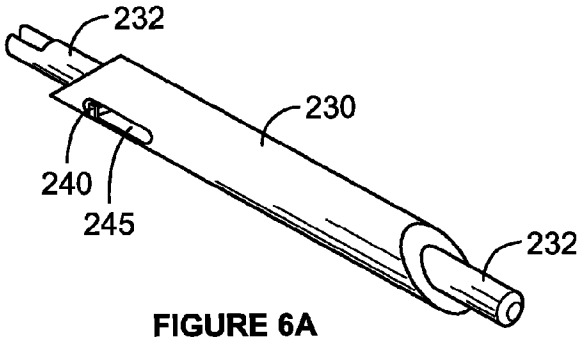
Figure 6B:
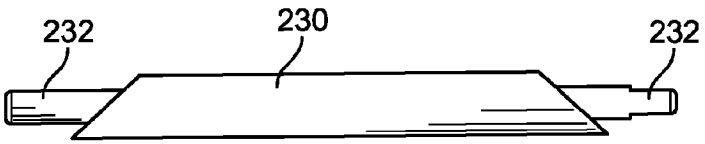
Figure 6C:
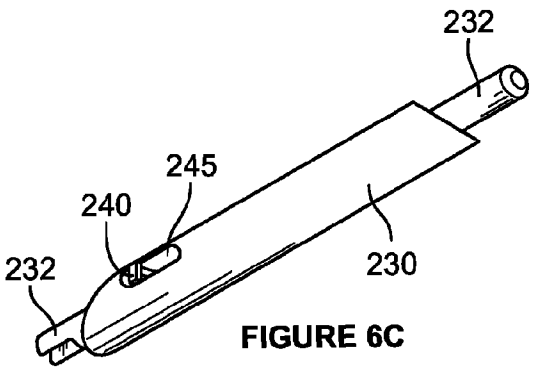

FIG. 3 illustrates that the third bars 140 each include a length of rope 180. The ends of the length of rope include a connection mechanism 185 such that the two ends can be connected to each other. When connected the third bars 140 and rope 180 can be used as a jump rope. This is further illustrated in FIG. 4. In this first embodiment, the bars can be made with a solid core material surrounded by a foam or soft outer covering. The material used to make the core could depend upon the desired weight of the bar.

Referring now to FIGS. 5A through 6F, there is a further embodiment illustrating the W shaped exercise bar 100 but having different components. Namely, the W shaped exercise bar 100 would include a pair of dumbbell bars 200 coupled together, similar to the dumbbells 160 and 170 mentioned above. Each dumbbell bar 200 would have two opposing slanted bars 205 that connect at a first end 210 to a transverse base bar 215. The two opposing slanted bars further include second ends 220 diametrically opposed to the first end. In addition, since the two opposing bars 205 are slanted, the second ends 220 are spaced apart by a distance further than the distance spaced by the first ends. Positioned intermediate of the first and second ends are apertures 225.

Handles 230 (illustrated in FIGS. 6A through 6F) are connect the two opposing bars 205 at the apertures 225. This is accomplished by having the handles 230 include pins 232 on each end that are received into the apertures 225 locking the handle 230 into place between the two slanted opposing bars. To position and remove the handle 230, one of the pins 232 would be retractable into the end of the handle. This can be done by including a spring-mechanism biasing the pin 232 in an outward position and include a slider 240 connected to the pin 232 that is accessible externally from the end. The slider 240 is set within a channel 245 to help dictate the movement of the slider. One benefit of having removable handles would be to having the handles weighted such that the user can increase or decrease the weight of the dumbbells and/or workout bar by switching the handle.

Referring back to FIGS. 5A through 5C, at the second end 220 of each opposing bar 205, the dumbbells 200 would include a first connector 250 and a second connector 255. The first connector 250 would interconnect with another first connector on a second dumbbell to form a middle section 110. The second connector 255 is illustrated at an angle to receive and connect to a third bar 140. As mentioned each of the third bars 140 would include a length of rope 180.

In another aspect the rope 180 could be coiled around an automatic re-coiling apparatus. This would ensure an easy and proper coiling and hinding of the rope 180 within the third bar when not in-use. The automatic re-coiling apparatus could be activated by an external button. Furthermore, the third bar 140 could include a removable cap end to access the rope if determined necessary.

Referring back now to FIG. 1, as outlined herein one embodiment of the invention includes an exercise bar 100. The bar 100 includes a middle sectional bar segment 110 having ends that separately connect to a pair of inner bars 120. The pair of inner bars 120 are angled outwardly and downwardly from the middle sectional bar 110 to form a V shape section. Each of the pair of inner bars 120 have an inner end 105 diametrically opposed to the ends of the middle sectional bar. The inner ends 105 are separately connected to a pair of outer bars 130, which are angled outwardly and upwardly from the inner end 105 of the inner bars 120. Each of the pair of outer bars 120 further has an outer end 105 diametrically opposed to the inner ends of the pair of inner bars 120. The outer ends of the outer bars 120 are separately connected to a pair of terminal bars 140. The pair of terminal bars 140 are angled outwardly and downwardly from the outer end of the outer bars. A pair of handles 150 are separately connecting one of the inner bars 120 to one of the outer bars 130 intermediate of ends defined by each of the inner and outer bars. Further, the middle sectional bar 110, the pair of inner bars 120, the pair of outer bars 130, the terminal bars 140, and the pair of handles 150 are all positioned substantially along a single plane.

In various aspects of the embodiment, the exercise bar could include a middle section bar that is a separable joint 155 such that the exercise bar can be split into two components 160, 170. Each component would be formed by at least one of the inner bars connected to one of the outer bars and having one of the handles connected between said inner and outer bars. Each component could then be used as a single handed dumbbell, while combined the exercise bar forms a W shaped two handed dumbbell.

In yet another aspect, the terminal bars 140 are defined as being removably attached to the outer bars. Each of the terminal bars 140 could include a hollow region, and a section of rope 180. The section of rope would be tethered at one end to the inside of the terminal bar and would include a diametrically opposed coupling end 185, such as a magnet. This would permit the two sections of rope 180 to be attached to each other at its coupling end 185 to form a jump rope. The terminal bars could include a retractable mechanism defined within the hollow region to automatically retract the rope within the terminal bar.

As defined by other aspects of the embodiments, the handles may include pins extending from ends defined thereby and set into apertures defined on the inner and outer bars. One of pins could be retractable into the end of the handle, such that the handle is removable and exchangeable with a second handle having a weight different than the removed handle.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

I claim:

1. An exercise bar comprising:

a middle sectional bar segment having ends;

a pair of inner bars separately connecting to the ends of the middle sectional bar, the pair of inner bars being angled outwardly and downwardly from the middle sectional bar, each of the pair of inner bars having an inner end diametrically opposed to the ends of the middle sectional bar;

a pair of outer bars separately connecting to the inner end of the pair of inner bars, the pair of outer bars being angled outwardly and upwardly from the inner end of the inner bars, each of the pair of outer bars further has an outer end diametrically opposed to the inner ends of the pair of inner bars;

a pair of terminal bars separately connecting to the outer end of the pair of second bars, the pair of terminal bars being angled outwardly and downwardly from the outer end of the outer bars, each of the pair of terminal bars further has a terminal end;

a pair of handles separately connecting one of the inner bars to one of the outer bars intermediate of ends defined by each of the inner and outer bar;

wherein the middle sectional bar, the pair of inner bars, the pair of outer bars, the terminal bars, and the pair of handles are all positioned substantially along a single plane; and wherein the handles include pins extending from ends defined thereby, and the pins are received in apertures defined on the inner and outer bars.

2. The exercise bar of claim 1, wherein the middle section bar further includes a separable joint such that the exercise bar can be split into two components, each component formed by at least one of the inner bars connected to one of the outer bars and having one of the handles connected between said inner and outer bars.

3. The exercise bar of claim 2, wherein each component is a single handed dumbbell.

4. The exercise bar of claim 1, wherein the middle sectional bar, the pair of inner bars, and the pair of outer bars, when assembled form a W shaped two handed workout bar.

5. An exercise bar comprising:

a middle sectional bar segment having ends;

a pair of inner bars separately connecting to the ends of the middle sectional bar, the pair of inner bars being angled outwardly and downwardly from the middle sectional bar, each of the pair of inner bars having an inner end diametrically opposed to the ends of the middle sectional bar;

a pair of outer bars separately connecting to the inner end of the pair of inner bars, the pair of outer bars being angled outwardly and upwardly from the inner end of the inner bars, each of the pair of outer bars further has an outer end diametrically opposed to the inner ends of the pair of inner bars;

a pair of terminal bars separately connecting to the outer end of the pair of second bars, the pair of terminal bars being angled outwardly and downwardly from the outer end of the outer bars, each of the pair of terminal bars further has a terminal end;

a pair of handles separately connecting one of the inner bars to one of the outer bars intermediate of ends defined by each of the inner and outer bar;

wherein the middle sectional bar, the pair of inner bars, the pair of outer bars, the terminal bars, and the pair of handles are all positioned substantially along a single plane; and wherein the terminal bars are removably attached to the outer bars, the terminal bars further include a hollow region, and include a section of rope, the section of rope being tethered at one end to the inside of the terminal bar and includes a diametrically opposed coupling end.

6. The exercise bar of claim 5, wherein the section of rope defined by each terminal bars is capable of being attached to each other at its coupling end to form a jump rope.

7. The exercise bar of claim 5, wherein the section of rope is coiled around a retractable mechanism defined within the hollow region to automatically retract the rope within the terminal bar.

8. The exercise bar of claim 1, wherein the handles can include a foam covering.

9. The exercise bar of claim 1, wherein one of the pins is retractable into the end of the handle, such that the handle is removable and exchangeable with a second handle having a weight different than the removed handle.

10. Exercise equipment comprising:

a middle sectional bar segment;

a pair of inner bars separately connecting to the middle sectional bar, the pair of inner bars being angled outwardly and downwardly from the middle sectional bar;

a pair of outer bars separately connecting to the pair of inner bars, the pair of outer bars being angled outwardly and upwardly from the inner end of the inner bars;

a pair of handles separately connecting one of the inner bars to one of the outer bars intermediate of the connections between the middle sectional bar segment and the inner bar and between the inner bar and outer bar, wherein the angles defined by the connection between the pair of outer bars, pair of inner bars, and the middle sectional bar forms a W-shaped two handed workout bar, wherein the middle section bar further includes a separable joint such that the exercise bar can be split into two components, each component formed by at least one of the inner bars connected to one of the outer bars and having one of the handles connected between said inner and outer bars two form a pair of single handed dumbbell;

a pair of terminal bars separately connecting to the outer end of the pair of second bars, the pair of terminal bars being angled outwardly and downwardly from the outer end of the outer bars, each of the pair of terminal bars further has a terminal end, and wherein the terminal bars are removably attached to the outer bars, the terminal bars further include a hollow region, and include a section of rope, the section of rope being tethered at one end to the inside of the terminal bar and includes a diametrically opposed coupling end.

11. The exercise bar of claim 10, wherein the section of rope defined by each terminal bars is capable of being attached to each other at its coupling end to form a jump rope.

12. The exercise bar of claim 10 wherein the section of rope is coiled around a retractable mechanism defined within the hollow region to automatically retract the rope within the terminal bar.

13. The exercise bar of claim 10, wherein the handles can include a foam covering.

14. Exercise equipment comprising;

a middle sectional bar segment;

a pair of inner bars separately connecting to the middle sectional bar, the pair of inner bars being angled outwardly and downwardly from the middle sectional bar;

a pair of outer bars separately connecting to the pair of inner bars, the pair of outer bars being angled outwardly and upwardly from the inner end of the inner bars;

a pair of handles separately connecting one of the inner bars to one of the outer bars intermediate of the connections between the middle sectional bar segment and the inner bar and between the inner bar and outer bar, wherein the angles defined by the connection between the pair of outer bars, pair of inner bars, and the middle sectional bar forms a W-shaped two handed workout bar, and wherein the middle section bar further includes a separable joint such that the exercise bar can be split into two components, each component formed by at least one of the inner bars connected to one of the outer bars and having one of the handles connected between said inner and outer bars two form a pair of single handed dumbbells, and wherein the handles include pins extending from ends defined thereby, and the pins are received in apertures defined on the inner and outer bars.

15. The exercise bar of claim 14, wherein one of the pins is retractable into the end of the handle, such that the handle is removable and exchangeable with a second handle having a weight different than the removed handle.

* * * * *